US008468798B2

(12) United States Patent
Odendall

(10) Patent No.: US 8,468,798 B2
(45) Date of Patent: Jun. 25, 2013

(54) PROCESS AND DEVICE FOR THE LAMBDA CONTROL OF AN INTERNAL COMBUSTION ENGINE WITH EXHAUST CATALYST

(75) Inventor: Bodo Odendall, Buxheim (DE)

(73) Assignee: Audi AG, Ingolstadt (DE)

( * ) Notice: Subject to any disclaimer, the term of this patent is extended or adjusted under 35 U.S.C. 154(b) by 1201 days.

(21) Appl. No.: 11/103,606

(22) Filed: Apr. 12, 2005

(65) Prior Publication Data

US 2005/0223696 A1 Oct. 13, 2005

(30) Foreign Application Priority Data

Apr. 13, 2004 (DE) ..... 10 2004 017 886

(51) Int. Cl.
*F01N 3/00* (2006.01)

(52) U.S. Cl.
USPC ..... 60/276; 60/274; 60/277; 60/285; 123/198 F; 123/481

(58) Field of Classification Search
USPC ..... 60/274, 276, 277, 285; 701/103, 701/109; 123/198 F, 481
See application file for complete search history.

(56) References Cited

U.S. PATENT DOCUMENTS 4,941,318 A * 7/1990 Matsuoka ..... 60/274
5,070,692 A * 12/1991 Nada ..... 60/274
5,099,646 A * 3/1992 Nada ..... 60/274
5,157,919 A * 10/1992 Gopp ..... 60/274
5,172,320 A * 12/1992 Nada ..... 701/103
5,842,340 A * 12/1998 Bush et al. ..... 60/274
5,848,528 A * 12/1998 Liu ..... 60/274
6,003,307 A * 12/1999 Naber et al. ..... 60/274
6,026,639 A * 2/2000 Kumar ..... 60/274
6,035,632 A * 3/2000 Stander et al. ..... 60/274
6,116,021 A * 9/2000 Schumacher et al. ..... 60/274
6,244,045 B1 * 6/2001 Purvis ..... 60/274
6,381,954 B1 * 5/2002 Kakuyama et al. ..... 60/285
6,405,527 B2 * 6/2002 Suzuki et al. ..... 60/285
6,718,754 B2 * 4/2004 Kobayashi et al. ..... 60/277
6,964,159 B2 * 11/2005 Lewis et al. ..... 60/285

OTHER PUBLICATIONS

Theophil S. Auckenthaler et al, Control-Oriented Investigation of Switch-Type Air/Fuel Ratio Sensors.
Theophil S. Auckenthaler et al, Aspects of Dynamic Three-Way Catalyst Behaviour Including Oxygen Storage, 2004.

(Continued)

*Primary Examiner* — Binh Q Tran
(74) *Attorney, Agent, or Firm* — Novak Druce Connolly Bove + Quigg LLP

(57) ABSTRACT

The invention relates to a process for the lambda control of an internal combustion engine with exhaust catalyst, having a lambda probe mounted downstream from the exhaust catalyst as control probe, a probe by means of which a post-catalyst lambda value of an exhaust gas flow leaving the exhaust catalyst is registered. Furthermore, a lambda control mechanism is provided by means of which the post-catalyst lambda value is set to a predetermined value such that a specific, predetermined degree of oxygen charging of an oxygen reservoir of the exhaust catalyst is set, the value predetermined for the degree of charging with oxygen of the oxygen reservoir being predetermined as a function of a predetermined degree of conversion of the exhaust catalyst.

13 Claims, 2 Drawing Sheets

OTHER PUBLICATIONS

Theophil S. Auckenthaler et al, Modeling of a Three-Way Catalytic Converter with Respect to Fast Transients of Sensor Relevant Exhaust Gas Components, 2004, American Chemical Society.

Theophil S. Auckenthaler et al, Modelling of a Solid-Electrolyte Oxygen Sensor, 2002, pp. 1293-1302, Society of Automotive Engineers, Inc.

Esfandiar Shafal et al, Indirect Adaptive Control of a Three-Way Catalyst, pp. 1-9; Zurich, Switzerland.

Theophil S. Auckenthaler et al, Online Estimation of the Oxygen Storage Level of a Three-Way Catalyst, 2004, pp. 1-10; Society of Automotive Engineers, Inc.; Switzerland.

Undisclosed Author(s); Control of Engine System, Air/Fuel Ratio Control System; pp. 189-202.

Hans J. Germann , et al; Fast Gas Concentration Measurements for Model Validation of Catalytic Converters; pp. 1-7; Swiss Federal Institute of Technology; Zurich, Switzerland.

* cited by examiner

Konvertierung = conversion

Konvertierung HC = HC conversion

Konvertierung $NO_x$ = $NO_x$ conversion

Befüllungsgrad Sauerstoffspeicher = degree of oxygen reservoir charging

Lambda nach Kat = post-catalyst lambda mager = lean fett = rich

PROCESS AND DEVICE FOR THE LAMBDA CONTROL OF AN INTERNAL COMBUSTION ENGINE WITH EXHAUST CATALYST

CROSS-REFERENCE TO RELATED APPLICATIONS

This application claims priority from German Application No. 102004017886.0, filed Apr. 13, 2004.

BACKGROUND

The invention relates to a method for controlling the lean operation of an internal combustion engine, especially an internal combustion engine of a motor vehicle, provided with a nitrogen oxide storage catalyst.

Control mechanisms in internal combustion engines for obtaining exhaust gases free to the greatest extent possible of pollutants have been disclosed; the oxygen content of the exhaust gas flow is measured and evaluated in such control mechanisms. In one generic, generally known process and a corresponding device, a special configuration is provided in the area of the exhaust catalyst, one consisting of a so-called lambda control probe upstream from the exhaust catalyst and a lambda guidance probe downstream from the exhaust catalyst. The efficiency of pollutant reduction by means of the exhaust catalyst is evaluated by means of the lambda control mechanism as a function of the probe signals determined by means of the two probes in the so-called two-point lambda control process. As soon as it is determined in the context of this evaluation that the catalyst no longer has an adequate conversion rate, a warning signal, for example, may be emitted which indicates catalyst replacement. The lambda control probe normally is a so-called constant lambda probe which can pick up a relatively wide lambda control signal in the range of approximately 0.7 to approximately 2. The lambda control probe is used to determine the lambda value of the exhaust gas composition upstream from the exhaust catalyst as a decisive influencing parameter for the conversion efficiency of an exhaust catalyst. Conversion for HC and CO, as well as for $NO_x$, assumes very good values only over a very small lambda range of approximately 0.99 to 1.01. The lambda guidance probe is normally a binary lambda probe of very high accuracy for precise adjustment of a lambda value. Corresponding wiring is necessary for both sensors, and structural space required must be present for the two sensors.

SUMMARY OF THE INVENTION

The object of the invention is development of a process and a device for lambda control of an internal combustion engine with an exhaust catalyst which may be executed or produced in a structurally simpler manner while ensuring high reliability of operation.

In one embodiment, the probe configuration with a lambda probe upstream from and a lambda probe downstream from the exhaust catalyst is replaced by a configuration with only a single lambda probe as a control probe downstream from the exhaust catalyst. A post-catalyst lambda value of an exhaust gas flow leaving the exhaust catalyst is recorded by means of this lambda probe. The post-catalyst lambda value is controlled by means of this lambda probe as a predetermined value such that a specific, assigned predetermined degree of oxygen charging is set and adjusted in an oxygen reservoir of the exhaust catalyst. This predetermined value of the degree of oxygen charging is in turn predetermined as a function of a predetermined degree of conversion of the exhaust catalyst.

What advantage is achieved by this mode of conduct of the process claimed for the invention is that the lambda probe upstream from the exhaust catalyst may be dispensed with, since, as a result of mode of conduct of the process claimed for the invention, the conversion efficiency of the exhaust catalyst then depends only on the current degree of charging with oxygen, and no longer on the lambda value of the exhaust gases entering the exhaust catalyst. Consequently, it is then necessary to provide only one lambda probe downstream from the exhaust catalyst as post-catalyst probe, one which, in accordance with the teaching as post-catalyst control probe claimed for the invention, performs a function entirely different from that of the guidance probe which may be provided in the conventional configuration. Considerable simplification and conservation are consequently achieved by means of a completely new concept related to the post-catalyst.

While only one conversion at a constant lambda value may be considered with the conventional control associated with use of a guidance probe, as a result of the invention the oxygen reservoir present in the exhaust catalyst may be used for a limited period to obtain good conversion values in the exhaust catalyst outside this constant input lambda value range of approximately 0.99 to 1.01 as well. A relationship is established between the post-catalyst lambda value and the degree of oxygen charging, in a manner such that there is associated with a specific oxygen charging degree of the oxygen reservoir a specific post-catalyst lambda value; for example, a post-catalyst lambda value of approximately 1 is associated with a degree of 50 percent charging of the oxygen reservoir. In the event of lower charging of the oxygen reservoir, the post-catalyst lambda value may then be displaced in the direction of rich and in the event of greater charging of the oxygen reservoir with oxygen in the direction of lean. This displacement is, however, very time-consuming and accordingly relatively low because of the delay for charging or discharging the oxygen reservoir. The result, in turn, is that a highly precise post-catalyst lambda signal only is required, while high precision requirements need not be set for a modeled oxygen input signal, for example.

Because of the low signal dynamics of the post-catalyst lambda signal, this signal may be employed as a slow guidance signal, for example. It can also be made certain by way of an integral component of a regulator that the desired predetermined lambda value always is reached downstream from the catalyst in order to achieve setting of the desired predetermined degree of oxygen charging.

A value ranging from 30 percent to 70 percent, preferably a mean value of 50 percent, in relation to the maximum degree of oxygen charging of the oxygen reservoir, will always be predetermined within the context of conduct of a specific process, while a value higher than 90 percent, preferably higher than 95 percent, is predetermined as the degree of conversion in addition or as an alternative. In accordance with one embodiment, these relationships may be plotted by preference in a performance graph of the lambda control mechanism. Very good HC, CO, and NOx conversion occurs in such an area between 30 percent and 70 percent of the degree of oxygen charging in relation to the maximum degree of oxygen charging. If the degree of charging increases distinctly in relation to the predetermined limits, decrease in the NOx conversion efficiency is to be noted, while conversely decrease in the HC and CO conversion is to be noted in the event of a distinct drop in the degree of charging.

In another especially preferred mode of conduct of the process, provision is made such that oxygen input to the exhaust catalyst is determined or modeled on the basis of the post-catalyst lambda value, for example, by means of the lambda control mechanism. The predetermined post-catalyst lambda value may then be adapted as a function of this oxygen input. Since high accuracy requirements no longer need be set for the modeled oxygen input signal in accordance with the present invention, rough but highly dynamic precontrol of the predetermined oxygen charging of the exhaust catalyst by way of a control loop of the oxygen charging modeling may be set. By special preference it is provided that a degree of charging of the oxygen reservoir to be expected is determined on the basis of the oxygen input in conjunction with an oxygen charging model. This value of the degree of oxygen charging to be expected is then again compared to the predetermined value of the degree of charging with oxygen, in such a way that appropriate adjustment of the post-catalyst predetermined lambda value is effected in the event of a divergence. In this way allowance may be made for operating states in which customary fuel delivery is interrupted, for example, because of fuel shutoff in the overrun or because of switching processes involving momentary interruption. Under such operating conditions, because of the design of the throttle it also is not possible completely to interrupt the delivery of fresh air, so that the internal combustion engine draws in fresh air even with the throttle valve fully closed. Since the oxygen contained in the fresh air is not fully burned in this instance but is rather delivered to the catalyst as pure oxygen, washing of the exhaust catalyst with oxygen takes place, as does also complete charging of the oxygen reservoir with oxygen. In the event of such complete charging of the oxygen reservoir, though, only poor conversion of $NO_x$ in the exhaust catalyst is possible. On the basis of the possibility claimed for the invention of adaptation of the predetermined value within the context of lambda control, however, after the occurrence of such disturbances the degree of charging with oxygen of the oxygen reservoir may be reset to a value at which good conversion of all pollutant components is possible, in the instance cited above by deliberate partial emptying of the oxygen reservoir to the predetermined value of the degree of charging to be set, for example, by enriching the mixture at predetermined intervals.

The object with respect to the device is attained by the characteristics specified in claim 6. The advantages named in the foregoing in connection with the process are obtained as a result, in particular the possibility of eliminating a probe upstream from the exhaust catalyst.

BRIEF DESCRIPTION OF THE DRAWINGS

The invention will be described in detail below with reference to a drawing, in which.

DETAILED DESCRIPTION OF THE INVENTION

Figure 1:
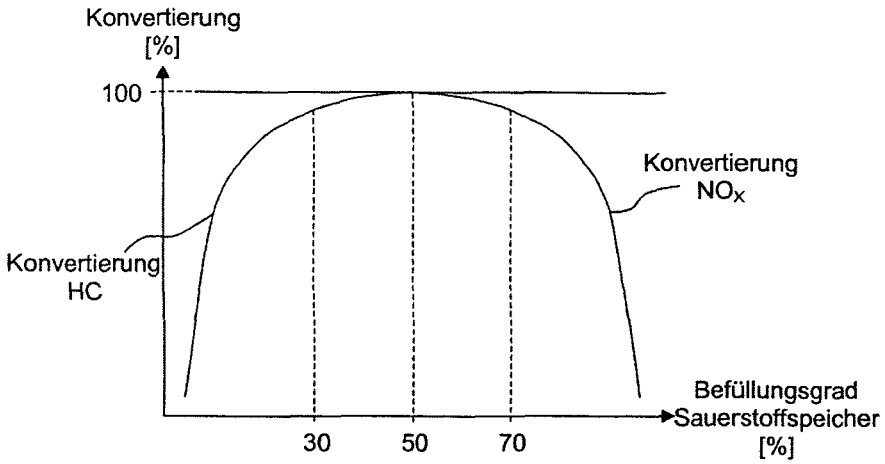
FIG. 1 presents a schematic diagram in which the conversion efficiency of an exhaust catalyst by way of the degree of charging of the oxygen reservoir of this catalyst is plotted, FIG. 2 a schematic diagram of the relationship of the lambda signal downstream from the exhaust catalyst to the degree of charging of the oxygen reservoir, and FIG. 3 a schematic diagram of an exhaust catalyst claimed for the invention.
Figure 2:
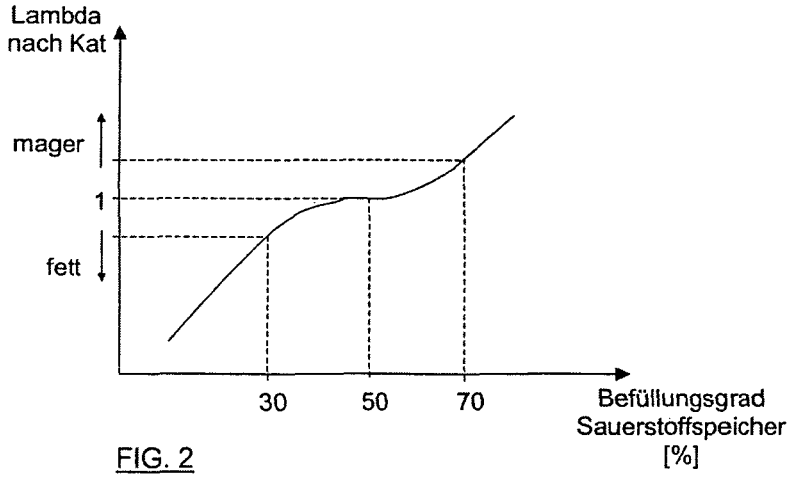

As is to be seen in the diagrams of FIGS. 1 and 2, the interrelationships of which are preferably plotted in a performance graph of the lambda control mechanism or the engine control device, the conversion efficiency of the exhaust catalyst approaches 100 percent when the oxygen reservoir of the exhaust catalyst is 50 percent full. Consequently, in accordance with the diagram in FIG. 2, the post-catalyst lambda value is set to a predetermined value of lambda=1 by means of the lambda control mechanism, since, as FIG. 2 shows, a lambda value of 1 is associated with charging of the oxygen reservoir to the extent of 50 percent.

Figure 3:
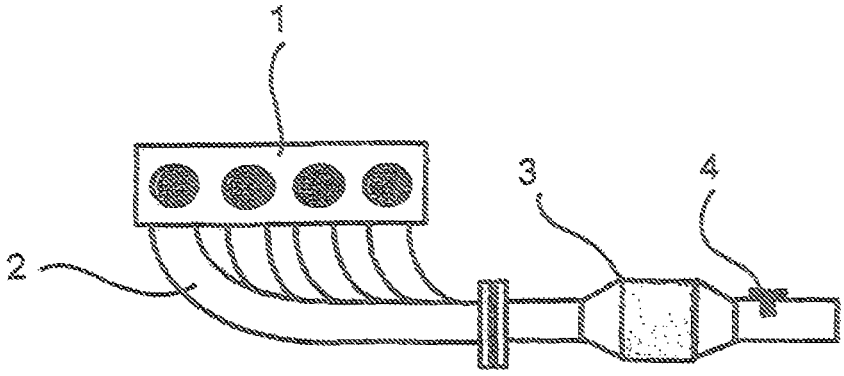

The result of such a mode of conduct of the process is that the conversion efficiency of the exhaust catalyst no longer depends on the lambda value of the incoming exhaust gases but on the current degree of charging of the oxygen reservoir of the exhaust catalyst. Hence, as a result of establishing a relationship between the post-catalyst lambda value and the degree of charging of an oxygen reservoir essentially different from that of FIG. 2, setting of the post-catalyst lambda value to an assigned predetermined value alone simultaneously effects setting of the degree of charging of the oxygen reservoir to a predetermined degree of oxygen charging, with the result that high accuracy requirements are set only for the post-catalyst lambda signal for exhaust gas conversion by the exhaust catalyst. Consequently, the probe of a conventional probe arrangement mounted upstream from the exhaust catalyst may be eliminated and the oxygen input signal necessary within the context of the on-board diagnosis may be modeled in a simple manner or, preferably, determined by the lambda probe mounted downstream from the exhaust catalyst on the basis of the post-catalyst lambda value, calculated, and plotted on a performance graph as a model. A diagram of the structure is shown in FIG. 3, in which an exhaust catalyst 3 is inserted downstream from a manifold section 2 of an internal combustion engine 1, which catalyst has only a control probe 4 as post-catalyst probe mounted downstream from the exhaust catalyst 3.

In FIG. 1 the left-hand portion of the curve represents the conversion of HC or CO and the right-hand portion the conversion of $NO_x$. As is to be seen in the diagram, optimum conversion of both HC and $NO_x$ is to be found, as has already been stated, in this instance at 50 percent charging of the oxygen reservoir. If the degree of charging of the oxygen reservoir falls distinctly below this optimum mean value of the degree of charging of the oxygen reservoir, decrease in HC conversion is to be noted, while decrease in the $NO_x$ conversion is to be noted in the event of distinct increase in the degree of charging of the oxygen reservoir.

Consequently, a specific range of charging of the oxygen reservoir, in this instance indicated as being 30 percent to 70 percent, within which a sufficiently good conversion efficiency of nearly 100 percent is specified, may be predetermined on the basis of the relationships presented in FIGS. 1 and 2. Adjustment of the post-catalyst lambda value may accordingly also be made within this range, that is, adequate conversion results may still be obtained even with a lambda value tending more in the direction of lean or rich of this 30 percent to 70 percent oxygen reservoir charging range.

In the event of interruption of delivery of fuel, as for example in the context of fuel shutoff in the overrun or in the context of switching processes involving momentary interruption, a flow of fresh air is drawn in as a function of the design of the throttle valve and then the catalyst is washed with oxygen, that is, a large amount of pure oxygen is delivered to the catalyst so that the oxygen reservoir is fully charged. Since, however, as illustrated in FIG. 1, this results in a distinct decrease in the conversion efficiency with respect to $NO_x$, it may be provided by means of the mode of conduct of the process as claimed for the invention that in the event of fuel shutoff in the overrun, for example, the degree of charging of the catalyst with oxygen may be adjusted to the predetermined value to be set ($\lambda$=1) in order rapidly to eliminate such a disturbance variable and to set the degree of charging of the oxygen reservoir back to a value at which good conversion is possible. That is to say, conduct of the process claimed for the invention by way of lambda control also makes control of the degree of oxygen charging of the oxygen reservoir possible or effects such charging in order to guarantee good conversion efficiency of the exhaust catalyst.

The invention claimed is:

1. A device for the lambda control of an internal combustion engine with an exhaust catalyst, comprising a single lambda probe as control probe mounted downstream from the exhaust catalyst without a lambda probe mounted upstream from the exhaust catalyst, a lambda control mechanism for adjustment of a post-catalyst lambda value to a predetermined value as a function of the predetermined degree of charging of an oxygen reservoir of the exhaust catalyst and as a function of the degree of conversion of the exhaust catalyst, means for determining an oxygen input to the exhaust catalyst based on a comparison of the post-catalyst lambda value and the predetermined value, wherein the predetermined value is a second lambda value of exhaust gas exiting an exhaust catalyst, wherein the determination of the oxygen input to the exhaust catalyst is made without considering a lambda value of exhaust gas entering the exhaust catalyst; and means for adapting the predetermined value as a function of the determined oxygen input.

2. The device of claim 1, further comprising a device for detecting an interruption of delivery of fuel, and means for delivering pure oxygen to the catalyst.

3. A process comprising determining a first lambda value of exhaust gas exiting an exhaust catalyst in an internal combustion engine;

determining an oxygen input to the exhaust catalyst based on a comparison of the first lambda value and a predetermined value, wherein the predetermined value is a second lambda value of exhaust gas exiting an exhaust catalyst, wherein the determination of the oxygen input to the exhaust catalyst is made without considering a lambda value of exhaust gas entering the exhaust catalyst; and adapting the predetermined value as a function of the determined oxygen input.

4. The process of claim 3, further comprising using a relationship between the second lambda value and a degree of charging of an oxygen reservoir of the exhaust catalyst to determine a current degree of charging of the oxygen reservoir based on the first lambda value;

wherein the degree of charging of the oxygen reservoir is determined as a function of a degree of conversion of the exhaust catalyst;

wherein the determination of the current degree of charging of the oxygen reservoir is made without considering a lambda value of exhaust gas entering the exhaust catalyst; and causing displacement of the first lambda value when the current degree of charging of the oxygen reservoir falls outside a predetermined range.

5. The process as claimed in claim 4, wherein the predetermined range is from 30 to 70 percent of the maximum degree of charging of the oxygen reservoir.

6. The process as claimed in claim 4, further comprising plotting the degree of charging with oxygen of the oxygen reservoir against the degree of conversion of the exhaust catalyst in a performance graph of a lambda control mechanism.

7. The process as claimed in claim 4, wherein the predetermined range to which the current degree of charging is compared corresponds to a degree of conversion of the exhaust catalyst of greater than 90 percent.

8. The process as claimed in claim 4, wherein the predetermined range to which the current degree of charging is compared corresponds to a degree of conversion of the exhaust catalyst of greater than 95 percent.

9. The process of claim 3 further comprising fully charging the exhaust catalyst with oxygen upon interruption of delivery of fuel to the engine.

10. A process for the lambda control of an internal combustion engine with an exhaust catalyst, comprising recording a post-catalyst lambda value of an exhaust gas flow leaving the exhaust catalyst with a lambda probe mounted downstream from the exhaust catalyst as control probe, and setting a post-catalyst lambda value with a lambda control mechanism to a predetermined value such that a specific, predetermined degree of oxygen charging of an oxygen reservoir of the exhaust catalyst is set, the value predetermined for the degree of charging of the oxygen reservoir being predetermined as a function of a predetermined degree of conversion of the exhaust catalyst, wherein inputting of oxygen into the exhaust catalyst modeled or determined as a function of the post-catalyst lambda value, and adjustment of the predetermined post-catalyst lambda value is effected as a function of the input of oxygen, the degree of charging of the oxygen reservoir with oxygen to be anticipated is determined on the basis of the input of oxygen in conjunction with an oxygen reservoir charging model, and the degree of charging of the oxygen reservoir with oxygen to be anticipated is compared to the predetermined degree of charging of the oxygen reservoir with oxygen, in such a way that, when a divergence is established by adjustment of the lambda value appropriate adjustment of the actual degree of charging with oxygen is effected in the direction of the assigned predetermined degree of charging with oxygen.

11. The process of claim 10, wherein the divergence is established by adjustment of the lambda value within the context of dynamic precontrol.

12. The process of claim 10, wherein adjustment of the actual degree of charging with oxygen is effected by means of mixture enrichment.

13. The process of claim 12, wherein the mixture enrichment is predetermined periodically.

* * * * *